United States Patent [19]

McClocklin

[11] 3,967,817

[45] July 6, 1976

[54] SWING CLAMP

[75] Inventor: Samuel B. McClocklin, Owatonna, Minn.

[73] Assignee: Owatonna Tool Company, Owatonna, Minn.

[22] Filed: Aug. 7, 1975

[21] Appl. No.: 602,760

Related U.S. Application Data

[63] Continuation of Ser. No. 487,570, July 11, 1974, abandoned.

[52] U.S. Cl. ..... 269/32; 269/94

[51] Int. Cl.[2] ..... B25B 5/06

[58] Field of Search ..... 269/24, 32, 91, 92, 269/93, 94

[56] References Cited

UNITED STATES PATENTS

| | | | |
|---|---|---|---|
| 2,683,386 | 7/1954 | Doebeli | 269/32 |
| 3,173,673 | 3/1965 | Northern | 269/32 |
| 3,336,022 | 8/1967 | Tridgell | 269/32 |
| 3,554,529 | 1/1971 | Thomas | 269/32 |

*Primary Examiner*—Roy Lake
*Assistant Examiner*—Mark S. Bicks
*Attorney, Agent, or Firm*—Wegner, Stellman, McCord, Wiles & Wood

[57] ABSTRACT

A swing clamp having a clamp arm pivotally mounted on a rotatable pivot shaft for movement between operative and inoperative positions and with the rotation of the pivot shaft being under the control of a pair of oppositely-acting pistons engageable with a crescent-shaped cam integral with the pivot shaft. Externally adjustable stops control the action of the pistons and limit the forces applied to the pivot shaft. The body of the swing clamp has two sets of passages alternately usable for controlling the direction of operation of the swing clamp and including a relocatable sequence valve.

3 Claims, 3 Drawing Figures

SWING CLAMP

This is a continuation, of application Ser. No. 487,570 filed July 11, 1974, now abandoned.

BACKGROUND OF THE INVENTION

This invention pertains to a swing clamp usable with machine tools and other devices wherein a clamp arm may be moved from an inoperative position to an operative position overlying an object, such as a workpiece to be clamped, and with the clamp arm then being moved into clamping relation with the object.

The prior art includes Northern et al Pat. No. 3,173,673 showing a swing clamp wherein opposed pistons operate against a pair of pins at the lower end of a pivot shaft. This structure does not have sufficient strength to resist impact and loading forces encountered in normal as well as abnormal operating conditions of the swing clamp nor does it have two-directional capability of operation with interchangeable valve components.

SUMMARY

A primary feature of the swing clamp disclosed herein is to provide a structure having sufficient strength to resist damage when the swing clamp encounters an obstacle before reaching its final operative position and also to resist high impact loading each time the swing clamp rotates between operative and inoperative positions resulting from the clamp arm coming to a sudden stop.

More particularly, the clamp arm is pivotally mounted on a rotatable pivot shaft mounted in a bore of the body of the device and the lower end of the pivot shaft has a crescent-shaped cam integral therewith and with an external surface having a curvature the same as the bore of the wall, whereby operating pistons acting against ends of the crescent-shaped cam result in rotation of the pivot shaft and with the forces exerted by the pistons acting in a direction whereby the wall of the bore supports the cam.

In the swing clamp disclosed herein, the body also mounts a clamping piston operable when the clamp arm is in operative position to pivot the swing clamp into clamping relation with an object. The body has two sets of identical fluid passages associated, one set with each of the cylinders mounting an operating piston whereby the swing clamp may be operated in either right-hand or left-hand operation and with a sequence valve positioned within one of said sets of fluid passages whereby fluid pressure is directed to the clamping piston after the swing clamp is rotated to operative position.

Another feature of the invention is to provide stop means associated with the pistons and adjustable externally of the body of the swing clamp and engageable by the operating pistons to limit the movement thereof to control the limits of rotation of the clamp arm and the pivot shaft which mounts the clamp arm and also absorb the force of the operating piston at the end of its stroke.

DESCRIPTION OF THE PREFERRED EMBODIMENT

Figure 1:
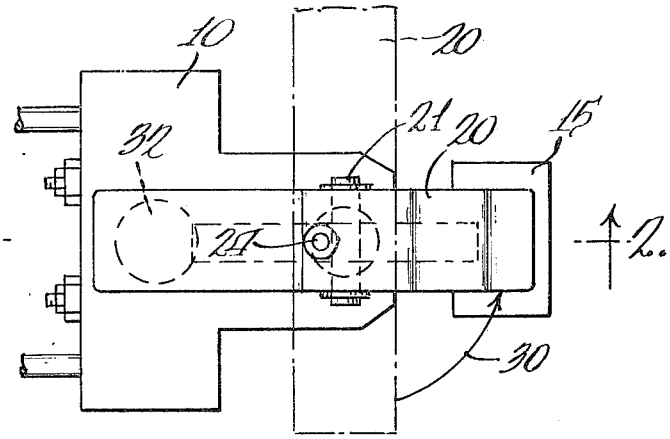
FIG. 1 is a plan view of the swing clamp shown in operative position in full line and in inoperative position in broken line.

The swing clamp has a body 10 mountable to a supporting surface 11 by means, such as bolts 12 for holding an object, such as a workpiece 15, against the surface 11. The swing clamp has a clamp arm 20 pivotally mounted intermediate its ends by a pivot pin 21 to a rotatable pivot shaft 22. The clamp arm 20 is normally urged in a counterclockwise direction about the pivot pin 21 by a spring 23 and with the position of the clamp arm being controlled by an adjustably threaded abutment member 24 engageable with the top of the pivot shaft 22.

Figure 2:
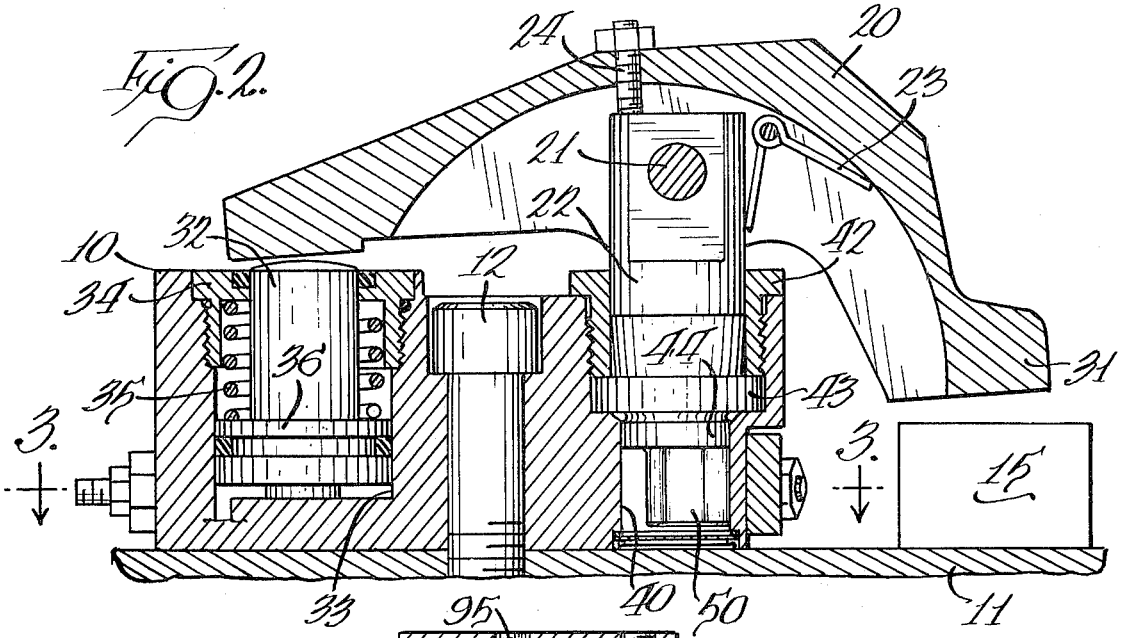
FIG. 2 is a vertical section, on an enlarged scale, taken generally along line 2—2 in FIG. 1.

As shown in FIG. 1, the clamp arm 20 has an inoperative position, shown in broken line, and in one hand of operation can be moved through an angle of 90°, as indicated by the arrow line 30, to the full line operative position overlying the object 15. With the clamp arm 20 in operative position as shown in FIG. 2, the clamp arm is moved in a clockwise direction to bring an engaging end 31 of the clamp arm 20 into pressure engagement with the object 15. This movement is caused by a clamping piston 32 mounted within a cylinder 33 formed in the body 10 of the swing clamp. The cylinder 33 has a cover 34 threaded thereto and through which the piston 32 extends and a spring 35 positioned between the cover and a flange 36 on the piston normally urges the clamping piston 32 to the retracted position, shown in FIG. 2. Delivery of fluid under pressure to the underside of the clamping piston causes extension thereof against the action of the spring 35 to have the clamping piston engage an end of the clamp arm 20 and pivot the clamp arm clockwise to cause engagement with the object 15.

The pivot shaft 22 is positioned within a bore 40 of the body 10 and has a section of its length of a diameter to be rotatably guided in a cap 42 threaded into the upper end of the bore 40 and with the cap engaging against a flange 43 on the pivot shaft to hold the pivot shaft in assembled relation with the body 10. Another part 44 of the pivot shaft is rotatably mounted in the lower part of the bore 40 and a crescent-shaped cam 50 extends beneath the part 44 with an outer surface 51 thereof coincident with the perimeter of the pivot shaft and in contact throughout its length with the wall of the bore 40.

Means including the crescent-shaped cam 50 are provided for moving the clamp arm 20 between the inoperative broken line position and the full line operative position of FIG. 1. This means includes a pair of operating pistons 60 and 61 positioned within a pair of cylinders 62 and 63 in the body 10 and with these two cylinders arranged at an acute angle and opening toward an end of the body 10 which is closed by a cover plate 64 fastened to the body by bolts 65.

Figure 3:
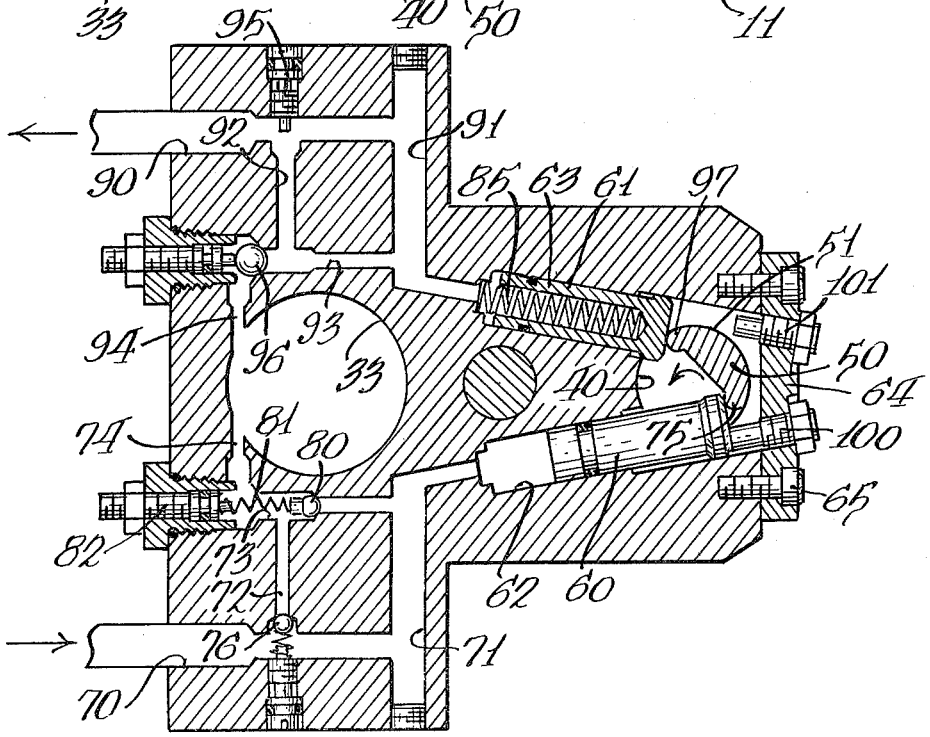
FIG. 3 is a plan section, taken generally along the line 3—3 in FIG. 2.

In the embodiment shown, the piston 60 is a fluid operated piston for moving the clamp arm in the direction of arrow 30 to an operative position and the piston 61 is a return piston. With the parts positioned as shown in FIG. 3, the clamp arm 20 is positioned as shown in FIG. 2, with the next operation being the extension of the clamping piston 32. Fluid is directed to the operating piston 60 through a first set of fluid passages, including an inlet passage 70 which extends to a passage 71 leading to the cylinder 62 for the piston 60.

A branch passage 72 extends from the inlet passage to a passage 73 which interconnects the passage 71 with a passage 74 leading to the bottom of the cylinder 33 for the clamping piston 32. When fluid, such as oil under pressure, is supplied to the inlet passage 70, this fluid is applied against the left-hand end of the operating piston 60 to extend the piston and have the piston, engaging an end 75 of the crescent-shaped cam 50, rotate the pivot shaft to bring the clamp arm 20 to the position shown in FIG. 2. Fluid does not reach passage 72 because of a ball check valve 76 at the entrance end of this passage. At the completion of the stroke of the piston 60, pressure builds up in the passage 71 to unseat a ball 80 of a sequence valve whereby fluid can flow from the passage 71 through the passage 73 into passage 74 and the bottom of the cylinder 33 to extend the clamping piston 32 and complete the clamping operation. The sequence valve includes a spring 81 acting against the ball 80 and threaded means 82 operable externally of the body 10 for setting the load on the spring 81 whereby the value of the pressure acting on the operating piston 60 before operation of the clamping piston 32 may be set.

During the extension of the operating piston 60, the piston 61 moves to a retracted position against the action of a spring 85 positioned within the hollow piston 61 and engaging against an end of the cylinder 63.

The clamping action can be released upon connection of the inlet passage 70 to tank with the force of spring 35 acting against the clamping piston 32 sufficient to unseat the ball check valve 76 and permit exhaust of fluid from the cylinder 33. The force of the spring 85 can be sufficiently high to cause spring return of the clamp arm to the broken line position of FIG. 1 by acting against the crescent-shaped cam 50 or, alternatively, fluid under pressure can be applied to a passage 90 which connects to a passage 91 for supplying pressure against the inner end of the return piston 61. Shift of the operating piston 60 toward the base end of its cylinder forces fluid to tank through the passage 70.

The passages 90 and 91 correspond to passages 70 and 71 and with additional passages 92, 93 and 94 there are, in effect, two sets of identical passages whereby either set may be used for delivery of fluid under pressure to one of the operating pistons to have either right-or left-hand operation of the swing clamp. This action is facilitated by having the ball check valve 76 interchangeable with a threaded plug 95 and having the sequence valve including the ball 80 interchangeable with a ball check valve 96 which is set to block communication between passages 92 and 93. With this interchange of a ball check valve and a sequence valve, it will be seen that delivery of fluid under pressure to the inlet passage 90 will cause extension of the operating piston 61 to cause clockwise rotation of the pivot shaft 22 as viewed in FIG. 3. This causes movement of the operating piston 60 toward the left against the action of the spring 85 which is moved from association with piston 61 to the cylinder 62 for coaction with piston 60.

The crescent-shaped cam 50 has a substantial cross-sectional area and is also supported by the wall of bore 40 to provide sufficient strength in the event the clamp arm 20 encounters an obstruction before reaching its final position and also to resist high impact loads.

Additionally, a pair of threaded adjustable stops 100 and 101 are mounted in the cover 64 and positioned in line with the end of each of the cylinders 62 and 63 for engagement with the respective operating pistons 60 and 61 at the ends of their operative strokes to absorb the full force of the operating piston which is moving under high pressure at the end of its stroke and as the crescent-shaped cam 50 has moved to the position of FIG. 3. The stops 100 and 101 are located whereby they may be engaged by an end of the pistons while the pistons are also engaging the ends 75 and 97, respectively, of the crescent-shaped cam. The stops may be adjusted externally of the swing clamp. Additionally, the stops function to locate the operative and inoperative positions of the clamp arm 20 and, thus, the swing clamp may be manufactured without requiring critical tolerances in the assembly of the clamp arm.

I claim:

1. A swing clamp comprising a body with a bore, a pivot shaft rotatably mounted in said bore and having an exposed end and an opposite end with an integral crescent-shaped cam having an outer surface coincident with the perimeter of the shaft and in contact with the wall of the bore, a clamp arm pivotally mounted on the exposed end of said pivot shaft for movement between operative and inoperative positions by rotation of the pivot shaft, a clamping piston positioned beneath an end of the clamp arm when the clamp arm is in operative position for pivoting the clamp arm relative to the pivot shaft, means for rotating said pivot shaft including a pair of operating pistons movable in cylinders extending toward said bore and at an acute angle to each other with said operating pistons in engagement with opposite ends of said crescent-shaped cam whereby force exerted by an operating piston rotates said pivot shaft and said cam is supported by the wall of the bore, one of said operating pistons being fluid operated, a stop for said last-mentioned piston positioned at an end of the cylinder and adjacent said cam to limit the stroke of the fluid operated piston, means external of the body for adjusting said stop along a line parallel to the axis of the last-mentioned piston and offset from the path of movement of the crescent-shaped cam, the stop being positioned for engagement by the last-mentioned piston while the latter also engages an end of the cam, and a hydraulic circuit including communicating body passages leading to said clamping piston and said fluid operated piston and a sequencing valve in one of said passages openable to direct hydraulic fluid to said clamping piston after the hydraulic fluid pressure has built up to a predetermined value resulting from said fluid operated piston being held against said stop.

2. A swing clamp comprising a body with a bore, a pivot shaft rotatably mounted in said bore and having an exposed end and an opposite end with an integral crescent-shaped cam having an outer surface coincident with the perimeter of the shaft and in contact with the wall of the bore, a clamp arm pivotally mounted on the exposed end of said pivot shaft for movement between operative and inoperative positions by rotation of the pivot shaft, a clamping piston positioned beneath an end of the clamp arm when the clamp arm is in operative position for pivoting the clamp arm relative to the pivot shaft, means for rotating said pivot shaft including a pair of operating pistons movable in cylinders extending toward said bore and at an acute angle to each other with said operating pistons in engagement with opposite ends of said crescent-shaped cam whereby force exerted by an operating piston rotates said pivot shaft and said cam is supported by the wall of the bore, one of said operating pistons being fluid operated, a stop for said last-mentioned piston positioned at an end of the cylinder to limit the stroke of the fluid operated piston, means external of the body for adjusting said stop along a line parallel to the axis of the last-mentioned piston and offset from the path of movement of the crescent-shaped cam whereby the stop is positioned for engagement by the last-mentioned piston while the latter also engages an end of the cam, two sets of fluid passages in said body alternately usable for delivering fluid pressure to the fluid operated piston whereby either of said operating pistons may be fluid operated, and a sequence valve positionable with one or the other of said sets of fluid passages to sequence fluid pressure to the clamping piston after rotation of the clamp arm to operative position.

3. A swing clamp comprising a body having a bore, a pair of cylinders in said body and each having an operating piston with one piston being a spring-loaded return piston and the other being selectively fluid operated, a pivot shaft rotatably mounted in said bore with an exposed end outwardly of the body, a clamp arm pivotably mounted on said end of the pivot shaft, means for rotating said pivot shaft between a first position and a second operative position including a crescent-shaped cam on an end of said pivot shaft with said cam having a curved surface matching a wall of the bore and said pair of operating pistons acting in opposition to each other and against opposite ends of the crescent-shaped cam with the forces of the operating pistons acting to urge the cam against the bore wall and rotate the pivot shaft, a clamping piston engageable with the clamp arm in said operative position for pivoting of the clamp arm on the pivot shaft, two sets of fluid passages in said body leading to said clamping piston and said other operating piston, a sequence valve between said last two mentioned pistons whereby said clamping piston is moved subsequently to said other operating piston and including means externally of the body for adjusting the pressure at which the sequence valve will open, there being a mounting in each of said two sets of passages for the alternate mounting of the sequence valve, and a ball check valve positioned in one of said mountings that does not have the sequence valve to enable opposite hand operation of the swing clamp.

* * * * *